US005226588A

United States Patent [19]

Schramm et al.

[11] Patent Number: 5,226,588

[45] Date of Patent: Jul. 13, 1993

[54] HOT MELT ADHESIVE PACKAGE

[75] Inventors: LeRoy J. Schramm, Jackson; David J. Nunez, Cedarburg; John M. Friesch, Whitefish Bay, all of Wis.

[73] Assignee: Great Lakes Packaging Corporation, Germantown, Wis.

[21] Appl. No.: 863,850

[22] Filed: Apr. 6, 1992

[51] Int. Cl.[5] ..... B65D 5/24; B65D 5/40

[52] U.S. Cl. ..... 229/149; 229/141; 229/150; 229/164

[58] Field of Search ..... 229/117.13, 126, 141, 229/143, 149, 150, 157, 164, 186

[56] References Cited

U.S. PATENT DOCUMENTS

| | | | |
|---|---|---|---|
| 306,532 | 10/1884 | Schmidt | 229/143 |
| 1,003,150 | 9/1911 | Potter | 229/143 |
| 2,269,013 | 1/1942 | Dorfman | 229/157 |
| 2,428,845 | 10/1947 | Guyer | 229/186 |
| 2,596,087 | 5/1952 | Shoudy | 229/117.13 |
| 2,805,813 | 9/1957 | Rittmueller | 229/157 |
| 3,330,467 | 7/1967 | Johnson | 229/126 |
| 3,415,358 | 12/1968 | Faller | 229/143 |
| 3,722,782 | 3/1973 | Collie | 229/126 |
| 4,236,740 | 12/1980 | Sorenson et al. | 229/143 |
| 4,846,398 | 7/1989 | Johnson | 229/186 |

FOREIGN PATENT DOCUMENTS

| | | | |
|---|---|---|---|
| 718927 | 1/1932 | France | 229/126 |

*Primary Examiner*—Gary E. Elkins
*Attorney, Agent, or Firm*—Michael, Best & Friedrich

[57] ABSTRACT

A package of one-piece folded construction includes a central, bottom portion having opposite parallel end edges and opposite parallel side edges. Plural end and side portions are attached to the bottom portion and arranged in serial fashion around the bottom portion as follows. A first end portion is attached to and extends laterally of an end edge of the bottom portion; a first side portion attaches to and extends laterally of a side edge of the bottom portion; a second end portion attaches to and extends laterally of another end edge of the bottom portion; and a second side portion attaches to and extends laterally of another side edge of the bottom portion. A gusset portion is provided between adjacent edges of respective ones of the end and side portions so that folding of the gussets orients the end and side portion generally perpendicular to the bottom portion. A first cover member attaches to one of the side portions and a second cover member attaches to the other side portion. The first and second cover members have extensions to overlap when folded generally parallel to the bottom portion. Locking tabs on the cover members and slots for receipt of the tabs when the cover members are folded parallel to the bottom portion are also enclosed.

12 Claims, 1 Drawing Sheet

HOT MELT ADHESIVE PACKAGE

BACKGROUND OF THE INVENTION

1. Field of the Invention

The invention relates to a package made from a single blank appropriately scored for fold assembly and more specifically, to a package made from a single blank appropriately scored that is adapted for receipt of hot material and storage of that material after it has cooled.

2. Description of the Prior Art

Hot melt adhesives are typically poured into packages in a liquid states and in set amounts at high temperatures of approximately 350° F. to 400° F. The adhesives are then allowed to cool to form a solid block within the package.

Prior art packages are sufficiently secure and leak proof and of sufficient integrity to contain these hot liquids when poured and when cooled and solidified. These prior art packages also provided for easy release of the contents of the package through use of release liners.

The problem with such prior art packages often is in their complex construction. Some prior art packages had several blanks from which the package was assembled. Several blanks requires learning a detailed set of instruction in order to be able to properly assemble the package. Other prior art packages that are constructed from a one-piece blank also required complex folding operations entailing learning many instruction in order to properly assemble the package. The complexities of these package constructions thus lead to increased time spent in learning how to assemble the packages and to significantly increased time spent in assembling the packages themselves.

Examples of these types of prior art include U.S. Pat. No. 2,419,646, issue to Inman, U.S. Pat. No. 4,148,429, issue to Burr et al. U.S. Pat. No. 4,465,227, issue to Hood et al. and U.S. Pat. No. 4,648,549, issued to Trutna.

It is an object of this invention to provide a package that is easily folded and assembled in a short period of time yet still maintains its self-supporting structure that is secure and leak proof.

Another object of this invention is to provide a package that is easy to learn to assemble, easy to manipulate into its assembled form and then easy to handle when filled.

A further object of this invention is to provide a package that is capable of being stored and shipped with other packages in a very compact a space while still retaining its easy handling capabilities.

SUMMARY OF THE INVENTION

The present invention provides for a package of one-piece folded construction. The package includes a generally central bottom portion having oppositely arranged, generally parallel end edges and oppositely arranged, generally parallel side edges. The plural end and side portions are attached to the bottom portion and arranged in serial fashion around the bottom portion as follows. A first end portion is attached to and extends laterally of second edge of the bottom portion. A first side portion is attached to and extends laterally of a side edge of the bottom portion. A second end portion is attached to and extends laterally of another end edge of the bottom portion. Finally, a second side portion is attached to and extends laterally of another side edge of the bottom portion. The package further includes gusset portions which extend between adjacent edges of respective ones of the end and side portions so that folding of the gussets orients the end and side portions generally perpendicular to the bottom portion. The package further includes a first cover member which is attached to one of the end or side portions and a second cover member which is attached to the other of the end or side portions and oppositely arranged relative to the first cover member. The first and second cover members have extensions from their respective side or end member to overlap when folded generally parallel to the bottom portion. The package further includes locking tabs on the cover member and slots on the end or side portion which do not have the cover portions extending therefrom for receiving the tabs when the cover member are folded parallel to the bottom portion.

Other features and advantages of the invention will become apparent to those of ordinary skill in the art upon review of the following detailed description, claims, and drawings.

DESCRIPTION OF THE PREFERRED EMBODIMENT

Figure 1:
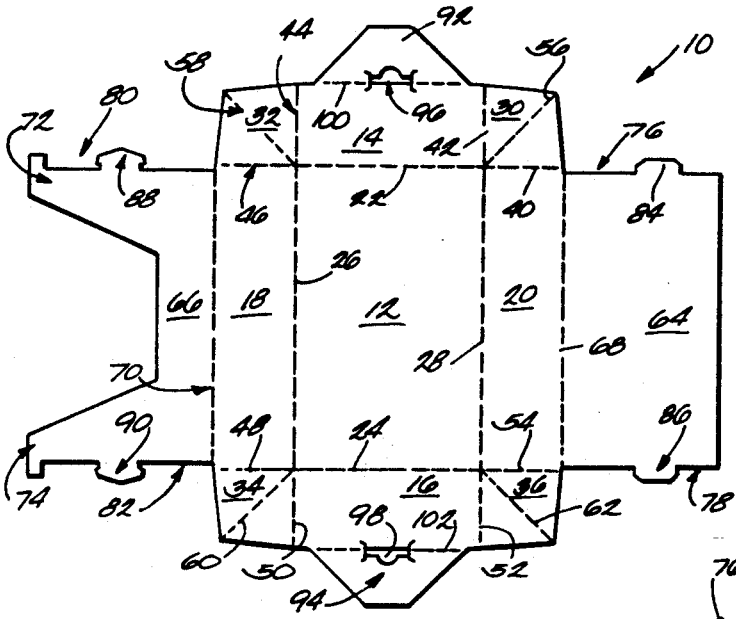
FIG. 1 is a plan view of the scored blank for forming the package with the score lines being shown as dashed lines.

Referring now to the drawings, there is shown a blank 10 from which a hot metal adhesive package 1 is constructed. The blank 10 is cut or stamped from chipboard or laminated paperboard. The blank is also lined on its interior to provide the package with a release coating to assure a later clean release of the contents of the package without residue. The release contain can be a conventional silicone based material, and applied in a conventional manner.

The blank 10 includes a central bottom portion 12 or bottom wall to which are foldably and integrally connected first and second end portions or end walls 14 and 16, respectively and first and second side portions or side walls 18 and 20, respectively. The central bottom wall 12, first and second end walls 14 and 16 and first and second side walls 18 and 20 are generally rectangular in shape. Score lines 22 and 24, respectively separate the central bottom wall 12 from the first and second end walls 14 and 16 and score lines 26 and 28, respectively separate the central bottom wall 12 form the first and second side walls 18 and 20. Each of the four pairs of adjacent end walls and side walls are connected by corner gusset portions 30, 32, 34, and 36, also foldably and generally connected in the blank 10. Score lines 40 and 42, 44 and 46, 48 and 50, and 52 and 54 radiating from each of the corners of the central bottom wall 12 define each corner gusset portion 30, 32, 34, and 36, respectively. IN addition, each corner gusset portion 30, 32, 34, and 36 is bisected by a diagonal score line 56, 58, 60, and 62, respectively.

A first cover member 64, which is generally rectangular, is integrally connected to and projects outwardly from the second side wall 20. Attached to the first side wall 18 is a second cover member 66. A portion of this second cover member has been cut away giving the second cover member 66 a U-shape and exposing the interior of the package when foldable as will be described more completely hereinafter. Score line 68 separates the second side wall 20 from the first cover member 64 and score line 70 separates the first side wall 18 from the second cover member 66. The second cover member 66 includes two dog ears 72 and 74; one on each of the two outer corners of the second cover member 66. The dog ears 72 and 74 support the second U-shaped cover member 66 when it is in a closed position. When the hot melt is poured into the package, it may be in the neighborhood of 350° F. to 400° F. and would heat the package elements. The dog ears 72 and 74 prevent the second cover member 66 from bending or drooping into the contents of the package where it could interfere with the fill operation.

The two outer end edges 76 and 78, 80 and 82 of both the first and second cover member 64 and 66 are provided with integrally extending locking tabs 84 and 86, 88 and 90, respectively. The locking tabs 84 and 86, 88 and 90 provide a tensioning mechanism to assure a tight seal of the package 11 and maintain package integrity during filling, handling and shipping.

The blank 10 also includes trapezoidal handle portions 92 and 94 and horizontal slots 96 and 98. The two trapezoidal handle portions 92 and 94 are integrally connected to each of the first and second end walls 14 and 16. The horizontal slots 96 and 98 are positioned between each of the first and second end walls 14 and 16 and each handle portion 92 and 94 adjacent to, preferably along, the score lines 100 and 102. The horizontal slots 96 and 98 are designed for receiving and interlocking with the locking tabs 84 and 88, 86 and 90 contained on both the first and second cover members 64 and 66.

Figure 2:
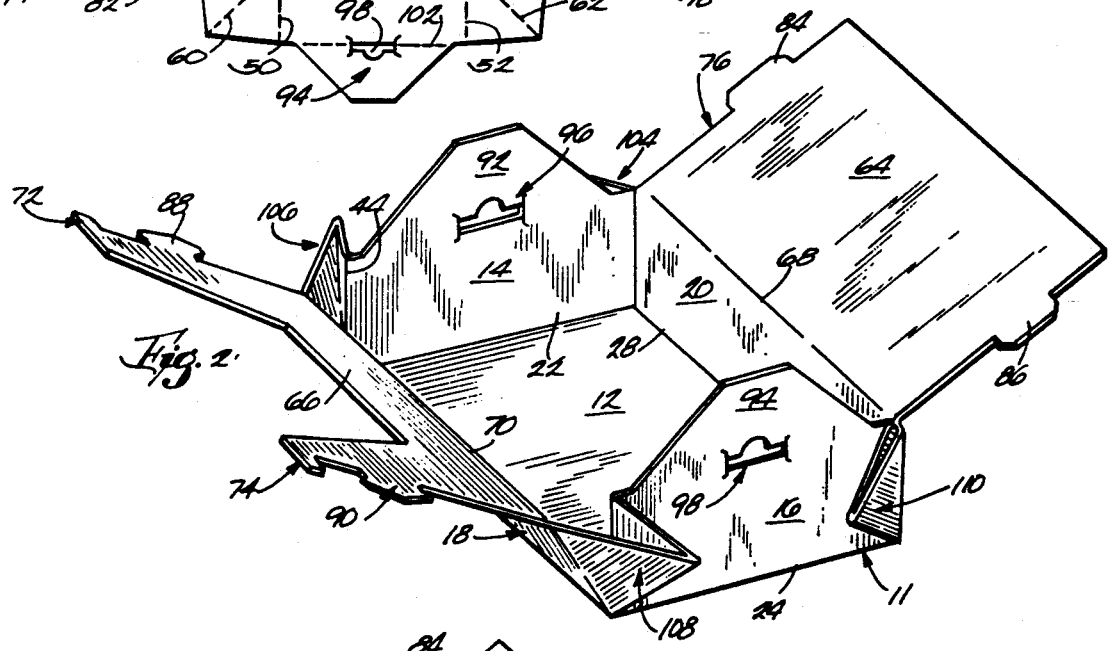
FIG. 2 is a perspective view of the partially assembled package showing the manner of folding the end, side and gusset portions.
Figure 3:
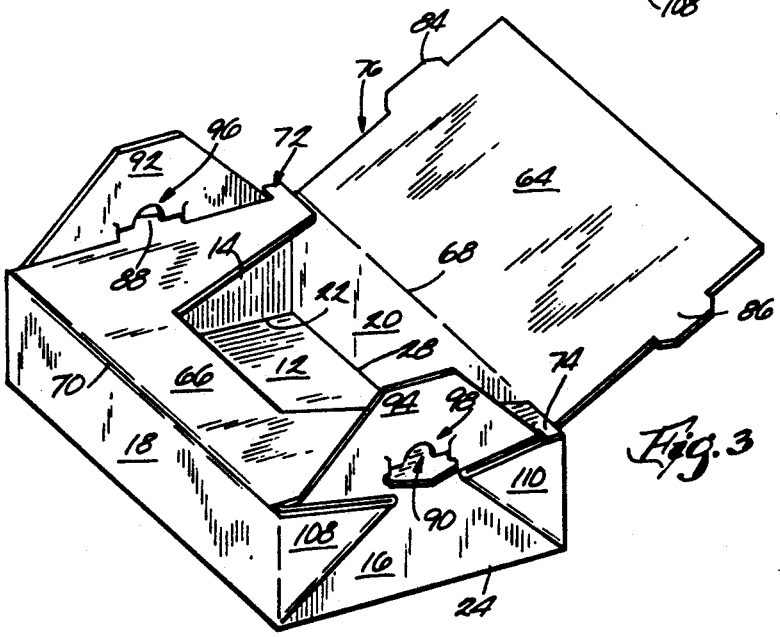
FIG. 3 is a perspective view of the package showing one of the cover members in the closed position.

To assemble the package 11, first, all of the score lines are initially creased. Next, the first and second end walls 14 and 16 and the first and second side walls 18 and 20 are folded upright to positions perpendicular to the central bottom wall 12 as in FIG. 2. Each outwardly projecting gusset portion 30, 32, 34, and 36 is folded along its respective diagonal score line 56, 58, 60 and 62 to form triangular panels 104, 106, 108, 110 which also project outwardly from the package. The four triangular panels 104, 106, 108, and 110 are then folded inwardly against their adjacent end walls 14 and 16 and permanently secured to the end walls thus holding the package in its erected position. In the preferred embodiment, glue is used to permanently secure the triangular panels 104, 106, 108, and 110 to the end walls 14 and 16. The second U-shaped cover member 66 is then folded downwardly and inwardly along its score line 70 until it is generally parallel to the central bottom wall 12. The second cover member 66 is secured in approximately this position by inserting the second cover member's locking tabs 88 and 90 into their respective horizontal slots 96 and 98 as in FIG. 3. The dog ears 88 and 90 of the second cover member 66 rest upon, overlap and project outwardly from each of the first and second end walls 14 and 16. The package 11 as depicted in FIG. 3, now in a rigid box shape, is ready for filling with the desired substance such as a liquid hot melt adhesive.

The second cover member 66 is generally U-shaped to allow filling to occur while this second cover member is in a closed, tab-locked position. Having the second cover member 66 in a closed position during filling adds to the structural integrity of the package during filling and closure and thus reducing the likelihood of leakage or spillage. The cut away portion of the second cover member provides a large target area for filling thus increasing the flexibility in positioning of the package during filling.

After filling has ceased, the package can then be closed. The first cover member 64 is folded downwardly and inwardly along its score line 68 until it is generally parallel with the central bottom wall 12 and overlaps enough of the second cover member 66 to fully enclose the contents of the package thus preventing the ingress of foreign material. The first cover member 64 is secured in place by inserting its locking tabs 84 and 86 into their respective horizontal slots 96 and 98. When the package 11 is closed, the handles 92 and 94 project upwardly from the package 11.

To remove the contents from the package, the locking tabs 84, 86, 88 and 90 on the first and second cover member 64 and 66 are withdrawn from their respective horizontal slots 96 and 98. Both cover members 64 and 66 can then be moved upwardly to expose the contents of the package. The contents can then be removed from the package by grasping the contents while still in the package and removing them upwardly or by inverting the package itself and allowing the contents to be released from the release liner by gravity.

The package 11 as depicted in the drawings is advantageous in that it provides for easy assembly, flexible filling, tight sealing and easy handling, storing and transporting. In particular, the package 11 is easily assembled in a short period of time. The end user can assemble the package just prior to filling thus saving storage space in eliminating the need for the end user to store the pre-assembled packages. In addition, the package 11 assumes a rigid box shape prior to filling. This rigid shape allows the package to maintain its structural integrity when being filled and when closed thus assuring a tight seal of the package and reducing the likelihood of spillage.

The package 11 allows for ease of handling and transporting through use of its handles 92 and 94. The upwardly projecting handles 92 and 94 allow an operator to easily lift and move individual packages or multiple packages. The handles 92 and 94 allow an operator to manipulate one or several packages without being exposed to its contents.

Additionally, the handles 92 and 94 are advantageous in that they are shaped and positioned to allow for convenient and efficient storing and transporting of filled packages. This is accomplished through nesting of filled packages. Nesting generally performed by placing one object atop another until a stack of objects of a desired height is obtained. With this invention, nesting can be done both easily and efficiently with the handles 92 and 94 remaining projecting upwardly and because the handles remain projecting upwardly. This is accomplished by positioning the central bottom wall 12 of the uppermost package to be nested between the handles 92 and 94 and atop of the first cover member 64 of the lowermost package to be nested. The handles 92 and 94 of the lowermost package remain in close proximity to the side walls of the uppermost package. This enables nesting of packages to be performed in the smallest amount of space while still allowing for convenient handling of the packages through use of the handles 92 and 94. Thus, this nesting arrangement allows for more stable and convenient stacking of the packages in a smaller space.

Although one embodiment of the present invention has been illustrated and described, it will be apparent to those skilled in the art that various changes and modifications may be made therein without departing from the spirit of the invention or from the scope of the appended claims.

We claim:

1. A blank for making a package of one-piece folded construction, said blank comprising, a generally central, bottom portion having oppositely arranged generally parallel end edges and oppositely arranged, generally parallel side edges, plural end and side portions attached to said bottom portion and arranged in serial fashion around said bottom portion as follows, a first end portion attached to and extending laterally of one of said end edges of said bottom portion, a first side portion attached to and extending laterally of one of said side edges of said bottom portion, a second end portion attached to and extending laterally of the other of said end edges of said bottom portion, and a second side portion attached to and extending laterally of the other of said side edges of said bottom portion, a plurality of gusset portions extending between adjacent edges of respective ones of said end and side portions so that folding of said gusset portions orients sad end and side portions generally perpendicular to said bottom portion, first and second cover members respectively attached to either said first and second end portions or said first and second side portions, said second cover member being oppositely arranged relative to said first cover member, said first and second cover member overlap when folded generally parallel to said bottom portion, means defining locking tabs on said cover member, and means on the end or side portions which do not have the cover members attached thereto and defining slots through said send or side portions for receipt of said tabs which project through said slot when said cover members are folded parallel to said bottom portion.

2. The blank of claim 1 wherein said end, said and gusset portions are connected and extend continuously around said bottom portion.

3. The blank of claim 2 including means defining score lines between said end and side portions and said bottom portion, between said gusset portions and respective ones of said end and side portions, and between said cover members and the end or side portions to which they are attached.

4. The blank of claim 3 wherein one of said cover members includes a generally U-shaped opening.

5. The blank of claim 4 wherein said means defining said slots comprise handle portions projecting laterally form the end or side portions to which they are attached so that when said end, side and gusset portions and said cover member are folded on said score lines, said handle portions project above said overlapped cover members.

6. The blank of claim 5 wherein said handle portions have opposite lateral edges and said gusset portions, when folded, extend inwardly of said opposite lateral edges of said handle portions so that when said package and a second package made from an identical blank are placed one atop the other to provide an upper and a lower package, the handles of said lower package nest between the gusset portions of said upper package.

7. The blank of claim 6 wherein said slots are located adjacent to where said handle portions and the end or side portions are attached.

8. A blank for making package of one-piece folded construction, said blank comprising, a bottom portion having oppositely arranged, generally parallel end edges and oppositely arranged, generally parallel side edges, plural end portions attached one to each of said bottom portion end edges and extending laterally therefrom, plural side portions attached one to each of said bottom portion side edges and extending laterally therefrom, gusset means for orienting said end and side portions generally perpendicular to said bottom portion, extending between adjacent edges of respective ones of said end and side portions first and second cover members respectively attached to either said end portions or said side portions, said second cover member is oppositely arranged relative to said first cover member, said first and second cover members overlap when folded generally parallel to said bottom portion, means defining locking tbs on said cover member, and means on the end or side portions which do not have the cover portions attached and defining slots through said end or side portions for receipt of said tabs which project through said slot when said cover members are folded parallel to said bottom portion.

9. The blank of claim 8 wherein said end and side portions and gusset means are connected and extend continuously around said bottom portion.

10. The blank of claim 8 wherein one of said cover portions includes a generally U-shaped opening.

11. The blank of claim 8 wherein said means defining said slots comprise handle portions projecting laterally form the end or side portions to which they are attached so that when said end and side portions, said gusset means and said covers members are folded said handle portions project above said overlapped cover members, and wherein said handle portions have opposite lateral edges and said gusset means, when folded, extend inwardly of said opposite lateral edges of said handle portions so that when said package and a second package made from an identical blank are placed on atop the other, to provide an upper and a lower package, the handles of said lower package nest between the gusset means of said upper package.

12. A package of one-piece folded construction comprising, a bottom portion having oppositely arranged, generally parallel end edges and oppositely arranged, generally parallel side edges, plural end and side portions attached to said bottom portion and arranged inertial fashion around said bottom portion as follows, a first end portion attached to and extending from one of said end edges of said bottom portion, a first side portion attached to and extending from one of said side edges of said bottom portion, a second end portion attached to and extending from the other of said end edges of said bottom portion, and a second side portion attached to and extending from the other of said side edges of said bottom portion, gusset portions extending between adjacent edges of respective ones of said end and side portions, said gusset portions orient said end and side portions generally perpendicular to said bottom portion, first and second cover members respectively attached to either said first and second end portions or said first and second side portions, said second cover member is oppositely arranged relative to said first cover member, said first and second cover members overlap when folded generally parallel to said bottom portion, mans defining locking tabs on said cover members, means on the end or side portions which do not have the cover members attached and defining slots for receipt of said tabs when said cover members are folded parallel to said bottom portion, said means defining said slots includes handle portions projecting above said overlapped cover members, and said handle portions having opposite lateral edges and said gusset portions extending inwardly of said opposite lateral edges of said handle portions so that when said package and a second package made from an identical blank are placed one atop the other to provide an upper and a lower package, the handles of said lower package nest between the gusset portions of said upper package.

* * * * *

UNITED STATES PATENT AND TRADEMARK OFFICE

CERTIFICATE OF CORRECTION

PATENT NO. : 5,226,588

DATED : July 13, 1993

INVENTOR(S) : LeRoy J. Schramm, David J. Nunez, John M. Friesch

It is certified that error appears in the above-identified patent and that said Letters Patent is hereby corrected as shown below:

Column 1, line 63, "second" should be --of an end--.

Column 2, line 37, "l" should be --ll-- and
line 59, generally" should be --integrally--.

Claim 1, Column 5, lines 38 and 40, "member" should be --members--.

Claim 2, Column 5, line 48, second occurrence of "said" should be --side--.

Claim 5, Column 5, line 61, "form" should be --from--;
line 63, "member" should be --members--.

Claim 8, Column 6, line 8, between "making" and "package" insert --a--;
line 29, "tbs" should be --tabs--; and
line 29, "member" should be --members--.

Claim 11, Column 6, line 55, "on" should be --one--.

UNITED STATES PATENT AND TRADEMARK OFFICE

CERTIFICATE OF CORRECTION

PATENT NO. : 5,226,588

DATED : July 13, 1993

INVENTOR(S) : LeRoy J. Schramm, et al.

It is certified that error appears in the above-indentified patent and that said Letters Patent is hereby corrected as shown below:

Claim 12, column 6, line 65, "inertial" should be --in serial--.

Signed and Sealed this

Fifteenth Day of March, 1994

*Attest:*

*Attesting Officer*

Bruce Lehman

BRUCE LEHMAN

*Commissioner of Patents and Trademarks*